United States Patent [19]

Gale

[11] 4,129,960

[45] Dec. 19, 1978

[54] INTERLOCKING BLOCKS

[75] Inventor: John A. Gale, Excelsior, Minn.

[73] Assignee: American Guidance Service, Inc., Circle Pines, Minn.

[21] Appl. No.: 694,170

[22] Filed: Jun. 9, 1976

[51] Int. Cl.[2] ..... A63H 33/08

[52] U.S. Cl. ..... 46/25

[58] Field of Search ..... 46/25, 24

[56] References Cited

U.S. PATENT DOCUMENTS

| | | | |
|---|---|---|---|
| 3,205,611 | 9/1965 | Onanian | 46/25 X |
| 3,405,479 | 10/1968 | Paulson | 46/25 |
| 3,523,384 | 8/1970 | Adelsohn | 46/25 |
| 3,717,948 | 2/1973 | Schnabel | 46/25 |
| 3,905,150 | 9/1975 | Dawn | 46/25 |

FOREIGN PATENT DOCUMENTS

| | | | |
|---|---|---|---|
| 1294865 | 5/1969 | Fed. Rep. of Germany | 46/25 |
| 2105568 | 8/1972 | Fed. Rep. of Germany | 46/25 |
| 1264926 | 5/1961 | France | 46/25 |
| 1339661 | 9/1963 | France | 46/25 |
| 908097 | 10/1962 | United Kingdom | 46/25 |
| 960965 | 6/1964 | United Kingdom | 46/25 |

*Primary Examiner*—F. Barry Shay

*Attorney, Agent, or Firm*—Burd, Braddock & Bartz

[57] ABSTRACT

Interlocking educational and recreational blocks in three-dimensional right rectangular form adapted to be connected vertically or laterally to form larger structures. Each block is characterized by a plurality of projecting connecting members on one surface and corresponding mating recessed connecting members on the remaining faces of the block. When precisely manufactured, the interlocking blocks are especially adapted for use in teaching the metric system and other mathematical concepts to school children and others.

8 Claims, 6 Drawing Figures

INTERLOCKING BLOCKS

The invention is directed to interlocking educational and recreational blocks in right rectangular form intended and adapted for the production of larger structures by connecting blocks either vertically or laterally, or both. Each block is characterized by a plurality of projecting connecting members of one face of the block and complementary recessed connecting members on each of the remaining five surfaces. The projecting members on one block are engageable with the recessed members of an immediately abutting block.

The interlocking blocks, according to the present invention, are illustrated in the accompanying drawings in which corresponding parts are identified by the same numerals and in which.

Figure 1:
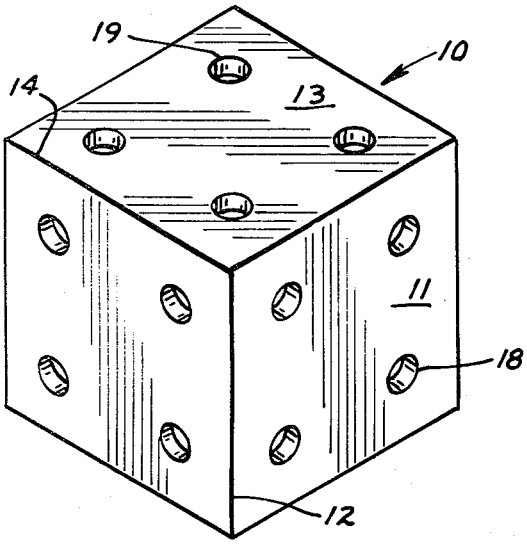
FIG. 1 is a perspective view of one single block.
Figure 2:
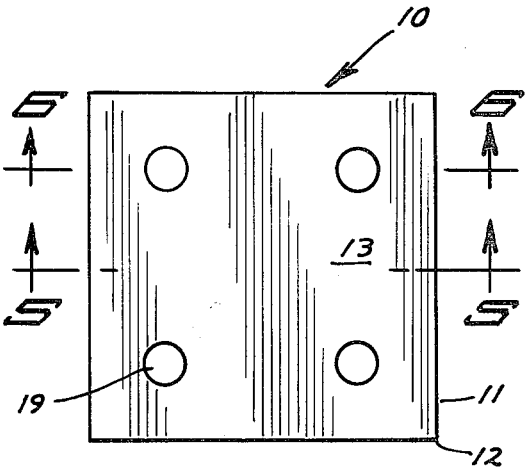
FIG. 2 is a top plan view thereof.
Figure 3:
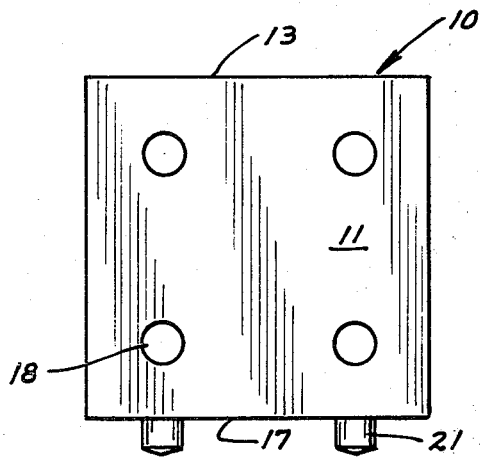
FIG. 3 is a side elevation thereof.
Figure 4:
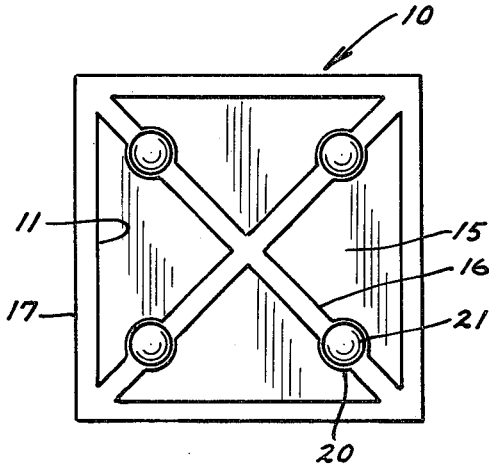
FIG. 4 is a bottom plan view thereof.
Figure 5:
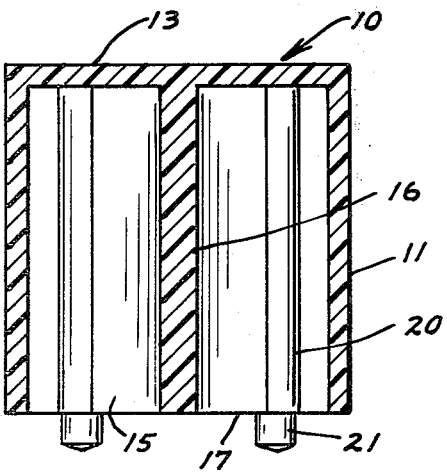
FIG. 5 is a section on the line 5—5 of FIG. 2 and in the direction of the arrows.

Referring now to the drawings, and particularly FIGS. 1 through 6, there is shown a block, indicated generally at 10, in the form of a cube. Block 10 has four identical vertical side walls 11, each having a planar face sharing a common edge 12 with two other adjacent side wall faces. The block has a horizontal top wall 13 having a planar face sharing a common edge 14 with each of the faces of side walls 11. Although it may be solid, to minimize material used and for ease of manufacture, the block 10 is preferably hollow and open at the bottom having a vertical cavity 15 divided into quarters by intersecting diagonal vertical ribs 16. The side walls 11 terminate in a bottom surface 17 surrounding the cavity 15.

Figure 6:
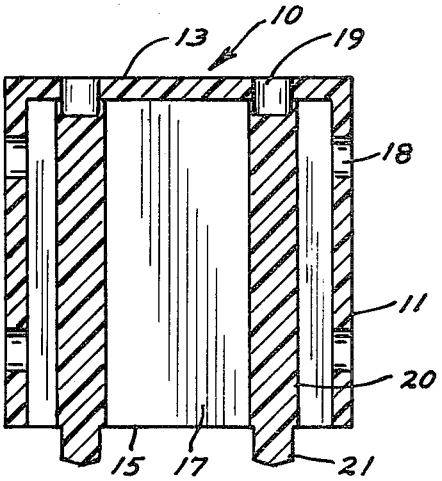
FIG. 6 is a section on the line 6—6 of FIG. 2 and in the direction of the arrows.

Each side wall 11 has four spaced apart apertures 18 spaced equidistantly from its top and bottom edges and side edges and, in the case of a hollow block, extending through the wall thickness. Top wall 13 also has four spaced apart apertures 19 spaced equidistantly from edges 14 in a pattern identical to that of apertures 18. Apertures 19 are recessed into the top wall and the top edges of reinforcing ribs 16, as shown in FIG. 6, and described in greater detail hereinafter.

Reinforcing ribs 16 are somewhat thicker in the areas 20 underlying apertures 19 and these cylindrical thickened portions terminate at the base of the ribs in downwardly projecting male connecting or interlock members 21, each of which projects below the bottom edge 17 of the block a distance corresponding generally to the depth of apertures 18 and 19. Interlock members 21 are preferably cylindrical. Their diameters correspond generally to the diameters of apertures 18 and 19. The projecting male interlock members 21 are positioned relative to the apertures 18 and 19 such that in blocks of the same size, the apertures serve as female interlock members to receive and engage the male members.

It will readily be seen that blocks of the same size may be connected vertically one upon the other, the members 21 being received in the apertures 19 in the top wall of the block. Similarly, by rotating a second block 90° relative to the first, the blocks may be connected on any one of the four vertical side wall surfaces of the first block. Although, for convenience, the block 10 has been illustrated and described with reference to top, bottom and sides, it is apparent that as more complex structures are formed from the basic block unit, the orientation of some of the blocks will be changed so that the top and bottom surfaces extend vertically and two of the side walls extend horizontally.

The preferred form of block structure is illustrated and described. It is contemplated that each block, although substantially rigid, will be formed by molding from a synthetic resinous material formulated so as to have some slight degree of resiliency. Optionally the end of each of the male interlock members 21 may have a slightly enlarged head (i.e., about 0.01 to 0.001 cm larger) and the edges of the female interlock members may be correspondingly very slightly undercut so that abutting blocks can be fit together with a snap fit. While the blocks are illustrated with the male interlock members projecting from the bottom surface only, the blocks may optionally have such male members projecting from other faces up to a total of three.

Polypropylene is a preferred material. Polyethylene, polyamides, polyvinyl chlorides, and the like, are exemplary of other resinous materials commonly available which provide the preferred properties. The block may interlock with a snap fit, or it may be formed to fit together with frictional engagement only between the male and female interlock members as shown. In this instance, the female interlock members are simple recesses of the same cross sectional configuration as the projecting male members. While it is preferred that the male members be cylindrical of circular cross section, other geometric configurations may be used.

It is preferred that each block be in the form of a cube. However, if desired, larger blocks may be made which are multiples of a cube simply by repeating the identical structure two times or three times, etc. In this manner, blocks of the same basic size can be intermingled so that a composite structure might be made up of combinations of units, doubles, triples, etc.

The interlocking blocks, according to the present invention, are adapted for the teaching of the metric system and other mathematical concepts to school children and others. For example, a preferred size of block is a cube measuring two centimeters on each edge. A number of such cubes stacked one upon the other may be used to measure linear distances. A plurality of cubes may be interconnected to form a larger solid structure for the teaching of calculation of volume and proving of that calculation. Preferably the block has a weight in grams corresponding to the length of each edge in centimeters, i.e., a two centimeter cube equals two grams in weight.

Although designed primarily for educational use, the blocks obviously may be used as toys for building all manner of structure. Instead of interconnecting blocks in one-to-one face-to-face relation, openwork structures may be formed with one block bridging a gap between two spaced apart blocks and interconnecting them. The blocks may be produced in any desired color or combination of colors.

It is apparent that many modifications and variations of this invention as hereinbefore set forth may be made without departing from the spirit and scope thereof. The specific embodiment described is given by way of example only and the invention is limited only by the terms of the appended claims.

The embodiments of the invention in which an exclusive property or privilege is claimed are defined as follows:

1. Interlocking educational and recreational hollow blocks each comprising a three-dimensional right rectangular structure having:

(A) four vertical side walls each having a planar face sharing common edges with two others, (B) a horizontal top wall having a planar face sharing a common edge with each of said side wall faces, (C) a flat bottom surface sharing a common edge with each of said side wall faces, said bottom surface defining an open face of said hollow block, said bottom surface further comprising the edges of intersecting diagonal ribs extending verticaly down from said top wall within said hollow block, (D) a plurality of male interlock members on said ribs projecting perpendicularly therefrom, one member adjacent each of the corners thereof, each of said members being spaced equidistantly inwardly from the adjacent pair of edges, and (E) a plurality of female interlock members engageable with the male members of an abutting block and recessed into each of the remaining wall faces, one member adjacent each of the corners thereof, each of said female interlock members being spaced equidistantly inwardly from the edges of the faces by the same distance said male interlock members are spaced inwardly from the edges and being of a depth sufficient to receive the length of a male member.

2. Blocks according to claim 1 further characterized in that:

(A) two of said side wall faces on opposite sides of said structure are square, and (B) the other two side wall faces and top wall face are rectangles in multiples of said first side wall faces.

3. Blocks according to claim 1 further characterized in that all of said side wall faces and top wall face are square.

4. Blocks according to claim 3 further characterized in that the weight of each block in grams equals the length of each common edge in centimeters.

5. Blocks according to claim 1 further characterized in that said male interlock members are circular in transverse cross section and each of said female interlock members includes at least one arcuate edge of corresponding radius.

6. Blocks according to claim 5 further characterized in that said male interlock members comprise a cylindrical shank having an enlarged head, and the arcuate surface of the female interlock member has a radius just slightly smaller than that of the head, whereby a male interlock member of one block is receivable into a female interlock member of an abutting block with a snap fit.

7. Interlocking educational and recreational hollow cubic blocks each having:

(A) four vertical square side walls, (B) a horizontal square top wall, (C) a flat square bottom surface, said bottom surface defining an open face of said hollow block, said bottom surface further comprising the edges of intersecting diagonal ribs extending vertically down from said top wall within said hollow block, (D) four male interlock members on said ribs projecting perpendicularly therefrom, one member adjacent each of the corners thereof, each of said members being spaced equidistantly inwardly from the adjacent pair of edges defining the corner, and (E) four female interlock members engageable with the male members of an abutting block of equal size and recessed into each of the remaining wall faces, one member adjacent each of the corners thereof, each of said female interlock members being spaced equidistantly inwardly from the edges of the faces by the same distance said male interlock members are spaced inwardly from the edges and being of a depth sufficient to receive the length of a male member.

8. Blocks according to claim 7 further characterized in that said male interlock members are circular in transverse cross section and each of said female interlock members includes at least one arcuate edge of corresponding radius.

* * * * *